United States Patent [19]

Lewis

[11] 4,091,483

[45] May 30, 1978

[54] HOSE CLAMP TOOL

[76] Inventor: Joe Lewis, 14917 S. Hoyne, Chicago, Ill. 60426

[21] Appl. No.: 794,830

[22] Filed: May 9, 1977

[51] Int. Cl.[2] ..... B25B 7/22

[52] U.S. Cl. ..... 7/132; 7/100

[58] Field of Search ..... 7/3 R, 5.4, 5.5; 81/9.3, 419, 421; 30/193, 258

[56] References Cited

U.S. PATENT DOCUMENTS

| | | | |
|---|---|---|---|
| 2,677,982 | 5/1954 | Arras et al. | 81/9.3 |
| 3,161,086 | 12/1964 | Kircher | 81/9.3 |
| 3,259,981 | 7/1966 | Raymond et al. | 30/258 X |
| 3,757,406 | 9/1973 | Bezar | 81/419 X |
| 4,028,756 | 6/1977 | Coutc | 7/5.5 |

FOREIGN PATENT DOCUMENTS

| | | | |
|---|---|---|---|
| 340,540 | 9/1921 | Germany | 81/421 |

*Primary Examiner*—James L. Jones, Jr.
*Assistant Examiner*—James G. Smith
*Attorney, Agent, or Firm*—Charles A. Laff; J. Warren Whitesel; Howard B. Rockman

[57] ABSTRACT

A pliers-like device is primarily designed to cut and remove clamps from flexible hoses, such as radiator hoses, for example. A tooth is formed at the end of each jaw of the pliers to reach under the hose clamp and start the cutting process. The opposed pliers jaws have interleaving blades, at least one of which has a knife edge. A pair of opposed cavities are formed on opposite jaws to hold the tab ends of a wire spring hose clamp while it is being expanded. The gripping jaws of a conventional pair of pliers are also provided.

4 Claims, 6 Drawing Figures

HOSE CLAMP TOOL

This invention relates to hand tools and more particularly to tools especially — although not exclusively — designed for cutting and removing hose clamps.

Conventionally, hose clamps surround and constrict a flexible tube to seal it against the wall of a rigid tube which is coaxially positioned inside the flexible hose. For example, the flexible tube might be a radiator hose on an automobile or a section of a garden hose in an automatic washing machine. The hose clamp might be a strap which is clamped by a tightened machine screw or a wire spring loop held in place by its own spring tension.

It is sometimes difficult to remove a hose clamp which has been in place for a number of years. The clamp becomes partially buried in the resilient material of the hose and it is difficult to work a pry in between the clamp and the hose. Sometimes the machine screw threads become rusted or corroded so that it is difficult to turn them and loosen the hose clamp. Also, the hoses are sometimes situated deeply among machinery so that it is difficult to reach them.

Since there are many different types of hose clamps and since there are the above cited and other problems, it has been the practice to use a great variety of tools which may or may not be appropriate or easy to use. Often, the removal of a hose clamp has ruined a good hose so that it has to be replaced.

Accordingly, an object of the invention is to provide new and improved hose clamp tools. Here, an object is to provide a hose clamp removal tool which performs almost all functions that are likely to be encountered when virtually any type of hose clamp is removed.

A more particular object of the invention is to provide a hose clamp cutting tool. In this connection, an object is to provide a tool which may cut straps, wire spring loops, or the like, even when they are drawn tightly and partially buried in the resilient material of the hose.

Another object of the invention is to provide hose clamp tools which are also useful for removing hose clamps without necessarily requiring them to be cut.

In keeping with an aspect of the invention, these and other objects are accomplished by providing a pliers-like device that is principally designed to cut clamps from radiator hoses. The clamps may be either metal straps or wire spring loops. A tooth is formed at the end of each jaw of the pliers to reach under the strap or wire hose clamp and thereby start the cutting process. The opposed jaws of the pliers have interleaving blades, at least one of which has a knife edge for cutting a strap of a hose clamp. In addition, a pair of opposed cavities are formed on opposite jaws to hold the tab ends of a wire spring hose clamping loop. Also, the inventive tool has a pair of gripping jaws similar to the jaws of a conventional pair of pliers.

A preferred embodiment of the inventive tool is shown in the attached drawings, wherein.

Figure 1:
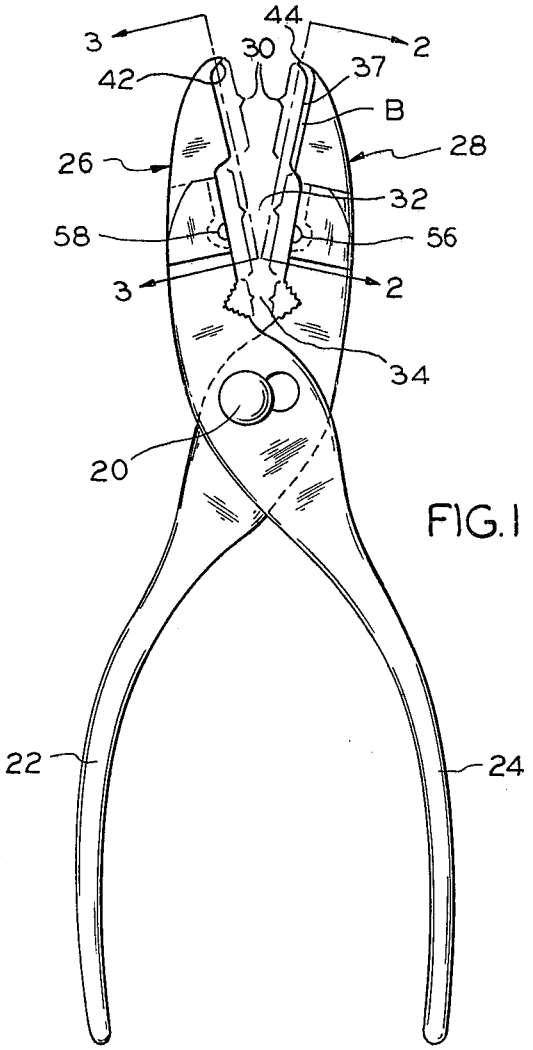
FIG. 1 is a plain view of an exemplary hose clamp cutter which embodies the invention.

The inventive tool (FIG. 1) comprises a pair of lever arms pivotly connected together at 20 to form a plier type of device. As here shown, the pivot point 20 is a slip joint, as commonly used on conventional pliers. A pair of handles are formed by parts 22, 24 of the lever arms which are below the slip joint 20. The parts 26, 28 of the lever arms which are above the slip joint 20 form opposing jaws. The ratio of the lengths of parts 22–28 is selected on a basis of the amount of mechanical advantage that is necessary or desirable.

The jaws 26, 28 are divided into three parts 30, 32, and 34. The outermost part 30 includes a pair of opposed cutting blades. The middle part 32 forms an opposed pair of cavities for gripping and manipulating the tab ends of a wire spring loop type of hose clamp. The innermost part 34 has opposed teeth for gripping a nut, bolt, or the like.

Figure 2:
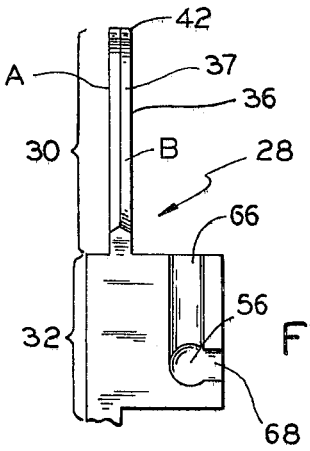
FIG. 2 is a side elevation view of one jaw of the pliers, taken along line 2—2 of FIG. 1.
Figure 3:
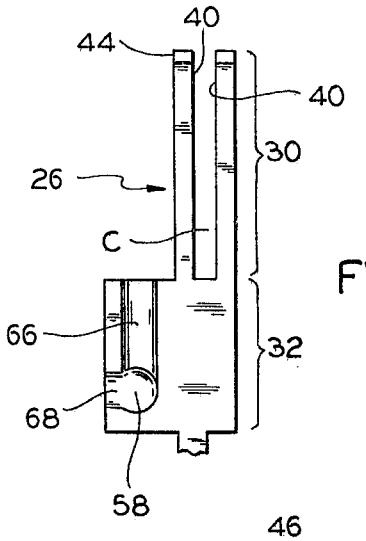
FIG. 3 is a side elevation view of the opposing jaw of the pliers, taken along line 3—3 of FIG. 1.

As best seen in FIGS. 2, 3, the end 30 of jaw 28 has one cutting blade 36, which is sharpened to a knife edge 37, by grinding beveled surfaces on the two sides A, B. The end 30 of jaw 26 has two anvil-like blades 40 which are separated by a gap or space C that provides just enough clearance to allow the blade 36 to pass there through. The knife edge 37 cuts the strap or wire of the hose clamp as it tautly spans the gap C, between the blades 40.

It might be possible to use conventional scissor blades at tool end 30; however, blades of this type are not preferred since they must remain firmly in side by side contact throughout the entire cutting stroke. As the tool wears and as the blades become duller, there is a much greater likelihood that the joint 20 may loosen and twist so that the blades separate slightly. Then, the hose clamp strap simply slips into that space between the blades, without being cut. Also, the angle at which the tool must sometimes be held in order to cut a strap tends to preclude the normal lateral application of hand pressure which holds conventional scissor blades together, during the cutting stroke.

At the tip ends 42, 44 of each of the blades 30, there is a tooth which projects inwardly toward the center of the jaws. Each tooth curves somewhat on the inner side in order to form guide surfaces for directing thetooth under the strap and for guiding the strap into the cutting bite between the blades. This way, the opposed teeth 42, 44 may reach under the strap, and pick it up and guide it to start the cut.

Figure 5:
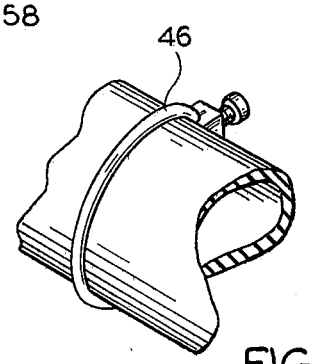
Figure 6:
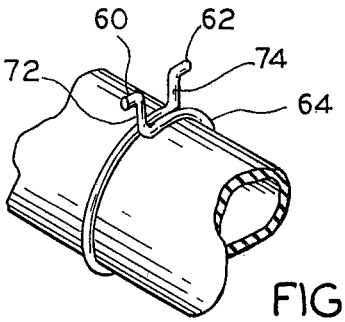

There is no problem when the teeth 42, 44 slip under a wire 46 (FIG. 5), with a circular cross section, since the curved walls of the wire also act as a guide which cooperates with the curved sections on the teeth.

Figure 4:
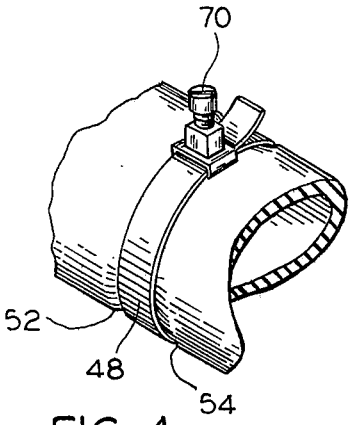
FIGS. 4–6 are perspective views of three different types of hose clamps which exemplify the problems that might be encountered when the invential tool is being used.

However, when the hose clamp 48 (FIG. 4) is a flat and ribbonlike strap, there are straight and perpendicular sides which do not function as such a guide surface. It is especially difficult to pick up the ribbonlike strap after it has been drawn so tightly that it is partly buried in the adjoining resilient material, as shown at 52, 54 in FIG. 4. The problem becomes even more acute after there has been a cold flow of the hose material. Therefore, the tip extremities of teeth 42, 44 should be as thin as the required mechanical strength will permit. Also, they should be rounded on all of the edges and corners to prevent them from digging into the hose material. This way, the nose of the pliers may be placed perpendicularly against the resilient hose material, with the teeth 42, 44 positioned on opposite sides of the strap 48.

When the pliers are pushed with a sufficient thrust, the resilient material 52, 54 may be depressed and the teeth 42, 44 have taken a bite upon the strap, their curved surfaces act as cams to lift the strap.

It should now be clear that the teeth 42, 44 may be slipped under almost any hose clamp. Once the teeth begin to lift the strap or wire of the hose clamp, the cam surfaces on the teeth guide it into the cutting bite of blades 30. The blade 36 interleaves with the blades 40 and travels through the gap C. This travel is far enough to insure a full and complete cutting of the cable hose clamp.

The section 32 of the tool of FIG. 1 includes a pair of cavities 56, 58 which are adapted to receive and hold the ends 60, 62 of a wire spring hose clamp 64. A surface channel 66, 68 on each of the jaws communicates with its associated cavities 56, 58 to receive the wire spring between the respective tips and the loop 64. This way, the wire is not forced out of the cavities when the pliers close. As the tool handles 22, 24 are squeezed together, the loop of the wire spring 64 may be expanded and slipped off the end of the hose.

It should be noted from FIGS. 2 and 3 that the communicating channels 66, 68 extend at right angles from the respective cavities. Therefore, the vertical ends 72, 74 of the wire spring loop fit into the communicating channels regardless of whether the tool is held with its jaws perpendicular or parallel to the axis of the flexible hose. However, it is thought that the tool will be held most often with the jaws held parallel to the axis of the hose when it is used on wire spring hose clamps.

In section 34 of the pliers, there are the usual jaws of conventional pliers with opposed teeth. This section of the tool is particularly useful for loosening screws or threaded bolts (such as screw 70) which are sometimes used to fasten hose clamps.

Those who are skilled in the art will readily perceive how various modifications may be made in the inventive tool. Therefore the appended claims are to be construed broadly enough to cover all equivalents falling within the true scope and spirit of the invention.

I claim:

1. A pliers-like tool comprising a pair of pivoted lever arms forming a pair of handles on one side of the pivot and a pair of opposed jaws on the other side of the pivot, the extremity of each of said jaws terminating in an outstanding tooth having a guiding cam surface on the inner side thereof, cutting means on the inner side of said jaws and positioned at the ends of said cams to receive and cut material picked up and guided by said tooth into the bite of the cutting means, an opposed pair of cavities respectively formed on said opposed jaws to receive the tip ends of a wire spring hose clamp, each of said opposing jaws including a pair of communicating channels extending away from each of said cavities, one of said channels extending parallel to the associated jaw and the other of said channels extending perpendicular to the associated jaw.

2. A pliers-like tool comprising a pair of pivoted lever arms forming a pair of handles on one side of the pivot and a pair of opposed jaws on the other side of the pivot, the extremity of each of said jaws terminating in an outstanding tooth having a guiding cam surface on the inner side thereof, cutting means on the inner side of said jaws and positioned at the ends of said cams to receive and cut material picked up and guided by said tooth into the bite of the cutting means, wherein said cutting means comprises a single knife blade on one jaw and a spaced pair of anvil-like blades on the other jaw, the space between said anvil-like blades providing just enough clearance to enable said single blade to pass therethrough, an opposed pair of cavities respectively formed on said opposed jaws to receive the tip ends of a wire spring hose clamp, wherein each of said opposing jaws includes a pair of communicating channels extending away from each of said cavities, one of said channels extending parallel to the associated jaw and the other of said channels extending perpendicular to the associated jaw.

3. The tool of claim 2 wherein said cavities are interposed between said blades and said pivot.

4. The tool of claim 3 and a pair of toothed plier jaws interposed between said cavities and said pivot.

* * * * *